US005667604A

United States Patent [19]

Karch

[11] Patent Number: 5,667,604

[45] Date of Patent: Sep. 16, 1997

[54] PROCESS FOR THE MANUFACTURE OF A SCRAPER OR BRUSH WIRE

[75] Inventor: Jörg Karch, Schacht-Audorf, Germany

[73] Assignee: RIWO-Drahtwerk GmbH, Rendsburg, Germany

[21] Appl. No.: 614,402

[22] Filed: Mar. 12, 1996

[30] Foreign Application Priority Data

Mar. 25, 1995 [DE] Germany ..... 195 11 057.9

[51] Int. Cl.[6] ..... C21D 8/06

[52] U.S. Cl. ..... 148/598; 148/599

[58] Field of Search ..... 148/598, 599

[56] References Cited

U.S. PATENT DOCUMENTS 3,647,571 3/1972 Okamoto et al. ..... 148/599

*Primary Examiner*—Deborah Yee

*Attorney, Agent, or Firm*—Vidas, Arrett & Steinkraus, P.A.

[57] ABSTRACT

A process for the manufacture of a scraper or brush wire with increased wear resistance, in which a rolled steel wire with a carbon content of approximately 0.6 to 0.7% and a diameter of approximately 6 mm and smaller is brought to a final diameter by at least one drawing process, where the wire is patented prior to the drawing or in between successive drawing processes, and after the drawing is heat-treated, and where a steel wire alloyed with a chromium content of 0.3% or smaller is used.

5 Claims, No Drawings

PROCESS FOR THE MANUFACTURE OF A SCRAPER OR BRUSH WIRE

FIELD OF THE INVENTION

The invention pertains to a process for manufacture of a scraper or brush wire with increased wear resistance.

BACKGROUND OF THE INVENTION

The manufacture of wire brushes, scraper belts, wire pins and the like requires wire types with special properties. The wire must have a high tensile strength and also a high flexibility. Conventional processes utilize unalloyed rolled wire of hardenable carbon steel, which is drawn with the aid of drawing dies to a predetermined diameter. Prior to the drawing process, or between successive drawing steps, occurs a patenting, i.e. a heat treatment for restoration of the drawing quality of the wire for example by heating the wire in a lead, salt or air bath in the range of 400°–550° C., followed by a quick cooling to achieve a perlitic structure or texture. After drawing to the final diameter, the wire is treated (tempered), i.e. austenized, stamped and annealed to provide it with the required strength and straightness.

Economical reasons necessitate that the wire has as small as possible a diameter prior to drawing. The raw wire is produced by roller working. The diameter is here preferentially 6 mm or less.

The service life of brushes or scrapers made of wires produced by conventional methods does insufficiently meet the expectations set for high-efficiency machines. One could think of improving the durability and therewith the service life of a wire by using an alloyed steel. However, this is opposed by disadvantages. The obtaining of a drawable purely pearlitic/sorbitic structure after the rolling by the process after the Stelmor cooling is not possible with the commonly used alloy contents for dimensions <6 mm. With the commonly utilized alloy contents the patenting is also not possible or can no longer be economically conducted, due to the long conversion times. However, this is necessary to create a drawable structure.

SUMMARY OF THE INVENTION

The invention is based on the goal to describe a process for the manufacture of a scraper or brush wire that without significant additional economic expenditure leads to a wire having a longer service life.

This task is fulfilled by the process of the invention. According to the invention, a rolled wire is used that is alloyed with chromium, with a chromium content of less than 0.3%. Specifically, the invention is a process for the manufacture of a scraper or brush wire, in which a rolled wire with a carbon content of approximately 0.6 to 0.7% and a diameter of approximately 6 mm and smaller is brought to the final diameter by at least one drawing process, where the wire is patented prior to the drawing or between succeeding drawing processes, and is tempered after the drawing, wherein a steel wire alloyed with chromium is used, the chromium content of which is 0.3% or less.

DETAILED DESCRIPTION OF THE INVENTION

Steel types that contain small amounts of alloying components are also called micro-alloyed steels. For example, it is known to use steel micro-alloyed with chromium and vanadium as tensile steel in order to increase the tensile strength. Tensile steels must, however, also have other properties than brush or scraper wire. Furthermore, such steel alloys, as used for example as tensile steel, can not be rolled to the desired diameter with a drawable pure pearlitic/sorbitic structure. Additionally, the vanadium would lose its effect in the patenting, due to grain growth.

According to a form of execution of the invention, the preferred chromium content lies between 0.2 and 0.25%. According to another form of execution of the invention, the drawn wire is treated such that the tempered structure is changed through carbide precipitation from the martensite toward the bainite stage.

It is understood that the starting wire used contains small amounts of other alloy metals, such as, e.g., manganese and/or silicon.

The process according to the invention yields a scraper or brush wire that with a pearlitic/sorbitic structure is rollable, patentable and can be tempered, without the heat treatment having a negative effect on the wear resistance. On the contrary, the wear resistance is clearly superior to that of the conventional scraper and brush wire. On the other hand, the ductility of the wire is not more unfavorable. E.g., for the manufacture of bristles for wire brushes, or teeth for scraping belts or such, a bending forming is required that can be accommodated without problems by the wire manufactured according to the invention.

The process according to the invention achieves that the alloy element chromium is precipitated in the steel as finely distributed carbide and, therefore, clearly has a wear-reducing effect. The manufacture of a rolled wire to the required small diameter, with pearlitic, sorbitic structure, e.g., with the aid of the so-called Stelmor process, does not pose any problems. The carbides dissolve above the austenitizing temperature and precipitate finely disperse on cooling. This is essential, because the tensile strength-enhancing and wear-reducing effect of the carbides formed by the alloying elements must not be allowed to be destroyed. For instance, this would be the case with the chromium-vanadium-alloyed tensile steels, if they would be heat-treated. The vanadium carbides would lose their tensile strength-enhancing properties through grain growth.

In an example of the process according to the invention a rolled wire of 5.5 mm diameter was used with a carbon content of 0.68%, a silicon content of 0.25%, a manganese content of 0.75%, and a chromium content of 0.2 to 0.25%.

The rolled wire showed a pearlitic structure and could without problems be drawn to the parenting diameter of 2.10 mm. After patenting, the wire was drawn to the final dimension of 0.52 mm.

For a brush wire, the following results were obtained:

| | |
|---|---|
| tensile strength | 2,500 N/mm$^2$ |
| yield point ratio | 45–55% |
| ductility | >5% |

In comparison to a conventional wire of equal tensile strength, a better yield point ratio and a higher ductility was obtained. The first ranges for the conventional wire between 70 and 90% and the latter at 3 to 5%. Hence, the wire of the invention exhibits at the same tensile strength clearly better values in regard to tensile strength and ductility.

The service life of a brash wire can only be judged in a brush. Brushes were made with inserts of various wires in order to test the service life, for which a commercially available brash was rated at 100%. Compared to such a brush, the test showed a service life extension of 40%.

The tests with a scraper wire manufactured according to the invention showed also a higher service life property through higher wear resistance. The wear-reducing properties of the chromium carbides are apparently also here effective. Prepared was a test wire of 0.405×0.305 mm. The setting results were good. Service life results are not available at this time.

I claim:

1. A process for the manufacture of a scraper or brush wire, comprising the steps of:

bringing a rolled steel wire with a carbon content of approximately 0.6 to 0.7% and a diameter of approximately 6 mm or less to a final diameter by at least one drawing process;

patenting the wire prior to each drawing process:

heating the wire to its austenitizing temperature, thereby dissolving carbides within the wire; and dispersing the carbides by cooling the wire into its martensitic stage and subsequently reheating the wire to its bainite stage, whereby fine carbide precipitation is achieved within a matrix, wherein a steel alloyed with chromium is used for said steel wire, the chromium content of which is 0.3% or less.

2. Process according to claim 1, wherein the chromium content is between 0.2 and 0.25%.

3. A process for the manufacture of a scraper or brush wire, comprising the steps of:

bringing a rolled steel wire with a carbon content of approximately 0.6 to 0.7% and a diameter of approximately 6 mm or less to a final diameter by at least one drawing process;

patenting the wire prior to each drawing process; and precipitating carbides within the wire by dissolving the carbides within the wire by heating the wire to its austenitizing temperature and dispersing the carbides by cooling the wire into its martensitic stage and subsequently reheating the wire to its bainite stage, wherein a steel alloyed with chromium is used for said steel wire, the chromium content of which is 0.3% or less.

4. A process for the manufacture of a scraper or brush wire, comprising the steps of:

bringing a rolled steel wire with a carbon content of approximately 0.6 to 0.7% and a diameter of approximately 6 mm or less to a final diameter by at least one drawing process;

patenting the wire prior to each drawing process, whereafter the wire is a pearlitic/sorbitic structure;

heating the wire to its austenitizing temperature, whereby carbides within the wire are dissolved;

cooling the wire into its martensitic stage and subsequently reheating the wire to its bainite stage, whereby the carbides are dispersed and finely precipitate within the wire, wherein a steel alloyed with chromium is used for said steel wire, the chromium content of which is 0.3% or less.

5. A process for the manufacture of a scraper or brush wire, comprising the steps of:

bringing a rolled steel wire with a carbon content of approximately 0.6 to 0.7% and a diameter of approximately 6 mm or less to a final diameter by at least one drawing process;

patenting the wire prior to each drawing process, whereafter the wire is a pearlitic/sorbitic structure; and hardening and tempering the wire by:

heating the wire to the austenitizing temperature;

cooling the wire into its martensitic stage; and reheating the wire to achieve a fine carbide precipitation within the wire, wherein a steel alloyed with chromium is used for said steel wire, the chromium content of which is 0.3% or less.

* * * * *

UNITED STATES PATENT AND TRADEMARK OFFICE
CERTIFICATE OF CORRECTION

PATENT NO. : 5,667,604

DATED : Sept. 16, 1997

INVENTOR(S) : JORG KARCH

It is certified that error appears in the above-identified patent and that said Letters Patent is hereby corrected as shown below:

Col. 2, line 63, delete "brash" and insert -- brush --;

Col. 2, line 66, delete "brash" and insert -- brush --;

Signed and Sealed this

Twenty-third Day of December, 1997

Bruce Lehman

*Attest:*

BRUCE LEHMAN

*Attesting Officer*

*Commissioner of Patents and Trademarks*